United States Patent [19]

Pearce, Jr.

[11] 4,319,799

[45] Mar. 16, 1982

[54] ELECTRICAL CONNECTOR WITH GROUP TERMINAL LOCK

[75] Inventor: Warren Pearce, Jr., Warren, Ohio

[73] Assignee: General Motors Corporation, Detroit, Mich.

[21] Appl. No.: 139,262

[22] Filed: Apr. 11, 1980

[51] Int. Cl.[3] ..... H01R 13/40

[52] U.S. Cl. ..... 339/217 R

[58] Field of Search ..... 339/217 R, 217 J, 217 PS, 339/217 S, 206, 207, 209, 210

[56] References Cited

U.S. PATENT DOCUMENTS

| | | | |
|---|---|---|---|
| 3,002,170 | 9/1961 | Clouthier | 339/217 J |
| 3,122,407 | 12/1961 | Cowe | 339/217 |
| 3,573,720 | 4/1971 | Reynolds | 339/217 R |
| 3,673,551 | 6/1972 | McDonough | 339/258 R |
| 3,958,853 | 5/1976 | Wilson | 339/99 R |
| 4,066,325 | 1/1978 | Pearce, Jr. et al. | 339/176 MP |
| 4,113,333 | 9/1978 | Horowitz | 339/217 R |

*Primary Examiner*—Joseph H. McGlynn
*Attorney, Agent, or Firm*—F. J. Fodale

[57] ABSTRACT

An electrical connector comprises mated plug and socket connectors. The plug connector comprises a connector body which houses a plurality of terminals having box-like contacts and hooks which project out of the terminal cavity openings at the mating end of the connector body. A lock plate having a pattern of holes corresponding to the cavity portion is attached to the mating end of the connector body to lock the terminals in the connector body as a group. The socket connector comprises a connector body having a socket which receives the mating end of the plug connector body. The socket connector has terminals which mate with the plug terminals and which are locked in the socket connector body by a comb.

4 Claims, 5 Drawing Figures

ELECTRICAL CONNECTOR WITH GROUP TERMINAL LOCK

This invention relates generally to electrical connectors and, more particularly, to electrical connectors which have means for positively locking a group of the terminals in the connector body.

One example of an electrical connector which has means for positively locking a group of terminals in the connector body is illustrated in U.S. Pat. No. 3,958,953 granted to Robert Everett Wilson on May 25, 1976. This patent discloses mating male and female connectors 10 and 12. The female connector 10 comprises a frame 18 which has two rows of recesses which hold two rows of terminals 26. Each terminal has a hook at the front contact end 26*f* which engages in a groove to retain each terminal individually in its proper recess. In addition, the two rows of terminals 26 are retained as a group by an end cap 42 which entraps rear tips 40 on the terminals 26. See FIGS. 5 and 7, particularly.

Another example of an electrical connector which has means for positively locking a group of terminals in a connector body is illustrated in U.S. Pat. No. 4,066,325 granted to Andrew Russo, Jr. and me on Jan. 3, 1978. In this patent, the electrical connector body 12 has two rows of cavities which hold two rows of terminals 20. Each terminal 20 is latched in its respective cavity by a terminal latch tab 62. One row of terminals is locked in their respective cavities as a group by a lock board 34 which is assembled in a rear slot in the connector body 12. A second lock board 34 locks the other row of terminals in the connector body.

A drawback to the above group terminal locks is that the terminal pattern is limited to two rows of terminals in the case of the former patent and one row of terminals in the case of the latter patent.

Accordingly, an important object of this invention is to provide a group terminal lock which allows a greater versatility in the terminal cavity pattern. This is generally accomplished by using a lock plate at the mating end of the connector body which has a hole pattern which matches the pattern of terminal cavities in the connector body. Thus the pattern of terminal cavities is not limited to one or two rows and the terminal cavities can be arranged in three, four or more rows.

Another feature of the invention is that different sizes of terminals and terminal cavities can be used in one connector body.

Another feature of the invention is that the lock plate is assembled to the mating surface of the connector where it is in plain sight. This provides good visibility for assembly and inspection.

Yet another feature of the invention is that the terminal cavities are easily cored while providing good terminal isolation.

Still another feature of the invention is that the lock plate guides mating terminals into proper engagement with the terminals in the connector body.

Other objects and features of the invention will become apparent to those skilled in the art as the disclosure is made in the following detailed description of a preferred embodiment of the invention as illustrated in the accompanying sheets of drawing in which.

Figure 1:
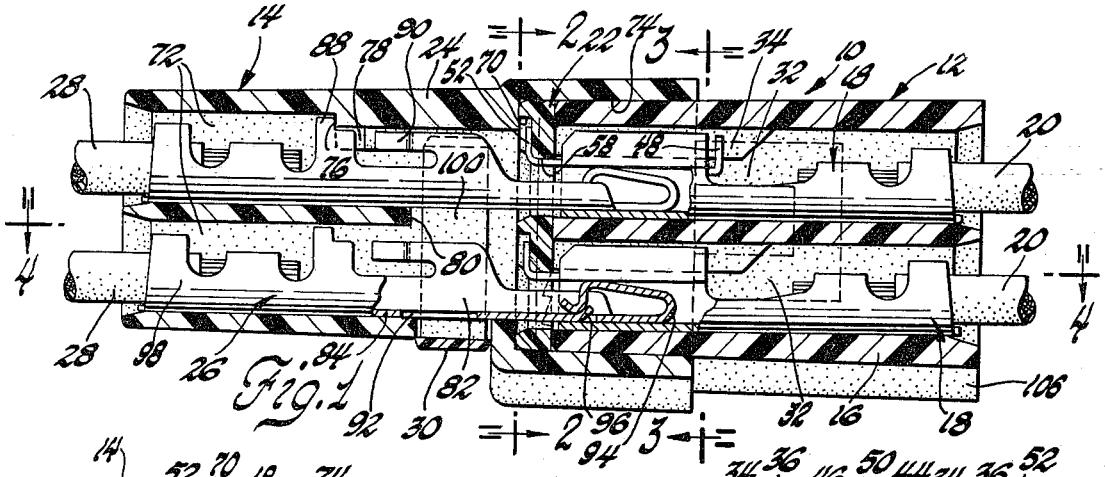
FIG. 1 is a longitudinal section through mating electrical connectors having a group terminal lock in accordance with this invention.

Referring now to the drawing, there is shown an electrical connector 10 comprising a plug connector 12 and a socket connector 14.

The plug connector 12 comprises a connector body 16, a plurality of terminals 18 which are disposed in the connector body 16 and attached to conductor wires 20 which lead out the rear end of the connector body, and a lock plate 22 attached to the mating end of the connector body 16.

The socket connector 14 comprises a connector body 24, a plurality of terminals 26 which are disposed in the connector body 24 and attached to conductor wires 28 which lead out the rear end of the connector body, and a lock comb 30 which is inserted into the mid-portion of the connector body.

Figure 4:
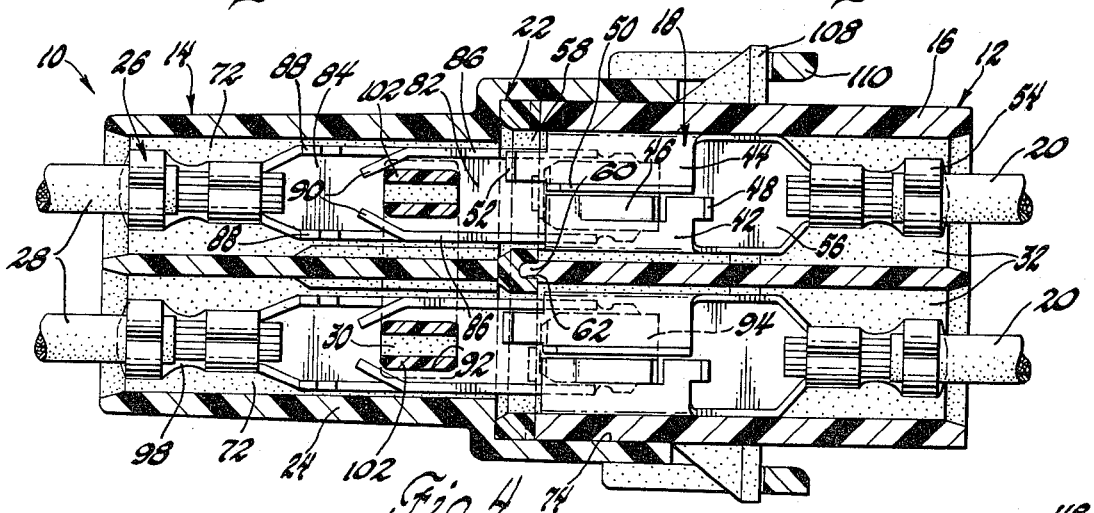
FIG. 4 is a section taken substantially along the line 4—4 of FIG. 1 looking in the direction of the arrows.

The mating end of the connector body 16 with the lock plate 22 attached thereto is plugged into a socket at the mating end of the connector body 24, where as shown in FIGS. 1 and 4, the terminals 26 engage the terminals 18 in the connector body 16.

The plug connector 12 will now be described in detail. The connector body 16 is a one-piece molding of dielectric material having four terminal cavities 32 arranged in two rows containing two cavities each. This simplest of arrangements is for illustrative purposes only as the principles of the invention are applicable to more complicated arrangements having several rows of terminals each containing several terminal cavities.

The terminal cavities 32 are rectangular in cross section and open at each end. The forward or contact end of each terminal cavity 32 has rails 34 at the two upper corners of the terminal cavity so that the cavity forward portion and opening 35 at the mating end of the connector are in the shape of an inverted T. Each terminal cavity 32 also has a lock shoulder 36 which extends part way across the slot formed by the rails 34. This shape of the terminal cavity 32 is easily formed in a molding operation by two mold cores which are inserted into the opposite open ends of the cavity 32 and abut at the lock shoulder 36.

The terminals 18 are of one-piece sheet metal construction. Each terminal 18 has a forward box-shaped contact comprising a floor 38, side walls 40 and 41 at the side edges of the floor 38 and inturned flanges 42 and 44 at the top edges of the respective side walls.

Flange 42 has a latch tang 46 which is pierced out of its inner portion and bent to project rearwardly and upwardly. Flange 42 also has a bent-up stop tab 48 which is at its rear edge and behind the latch tang 46. Flange 44 has a bent-up longitudinal rib 50 at its inside edge and a bent hook 52 at its front edge which projects forwardly of the box-shaped contact and the mating end of the connector body 16 when the terminal 18 is properly disposed in the terminal cavity 32.

The forward box-shaped contact is connected to a conventional crimpable conductor attachment portion 54 by a channel-shaped transition 56 which is attached to the floor 38 and side walls 40 and 41.

The terminals 18 are inserted into the terminal cavities 32 through the rear openings and individually retained in their respective cavities by the latch tangs 46 engaging front faces of the lock shoulders 36. The stop tabs 48 engage the rear faces of the lock shoulders 36 to prevent over insertion.

When the terminals 18 are individually retained in their respective cavities 32, the hooks 52 extend out of the forward openings 35 of the cavities 32 at the mating end of the connector body 16. The terminals 18 are then locked as a group by the lock plate 22.

The lock plate 22 has four rectangular holes 58 arranged in two rows of two holes each to correspond to the pattern of the terminal cavities 32 in the connector body 16. The rectangular holes 58 are shaped like the lower cross bar portions of the inverted T-shaped openings 35 at the mating ends of the terminal cavities 32 and are large enough to allow the projecting hooks 52 to pass through.

Figure 5:
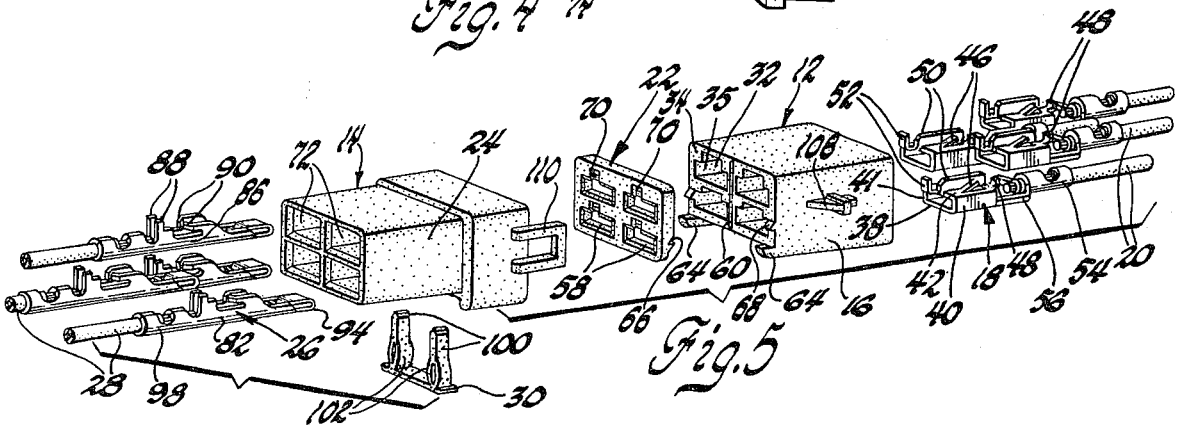
FIG. 5 is an exploded perspective view of the mating electrical connectors shown in FIG. 1.

The lock plate 22 is assembled to the connector body 16 by aligning the rectangular holes 58 with the projecting hooks 52 and then placing the lock plate 22 against the mating end face of the connector body 16 in a raised, vertically offset, position. In the offset position, the hooks 52 project into the rectangular holes 58 and the lock plate 22 is laterally located by a vertical guide rib 60 at the mating end face of the connector body 16 and a cooperating vertical guide groove 62 in the back of the lock plate 22. The lock plate 22 is then slid down to a terminal locking position against stops 64 formed on the connector body 16. The back of the lock plate 22 has recessed triangular lock projections 66 which cooperate with triangular lock projections 68 formed on the connector body 16 to retain the lock plate 22 in the terminal locking position shown in the drawings. In this position, portions 70 of the lock plate 22 adjacent the holes 58 are disposed behind the hooks 52 to prevent the terminals 18 from being pulled out of the terminal cavities 32 through the rear openings. The lock plate 22 thus provides a positive lock which locks the entire group of terminals 18 and which is stronger than the latch tangs 56 which lock the terminals 18 individually. The portions 70 are preferably recessed, as best shown in FIGS. 1 and 5, so that the hooks 52 do not protrude.

Figure 2:
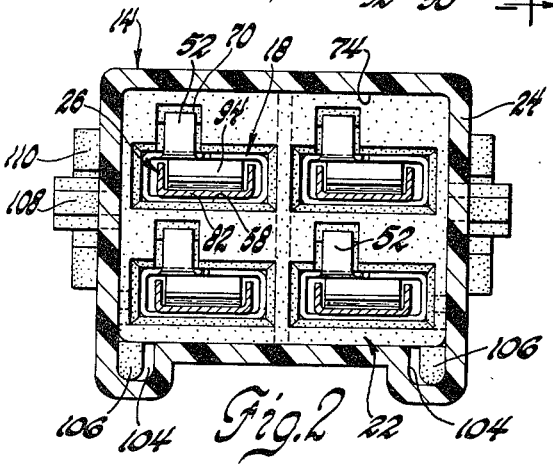
FIG. 2 is a section taken substantially along the line 2—2 of FIG. 1 looking in the direction of the arrows.
Figure 3:
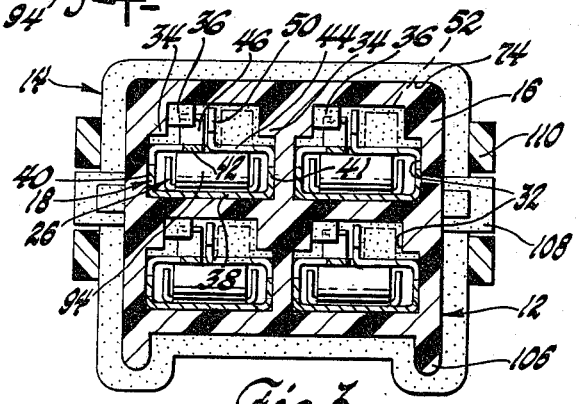
FIG. 3 is a section taken substantially along the line 3—3 of FIG. 1 looking in the direction of the arrows.

When the lock plate 22 is in the terminal locking position, the slot portions of the cavities 32 are covered and the holes 58 are aligned with the box-like contact portions of the terminals 42 as shown in FIG. 2. Thus the holes 58 serve as guides for properly mating the terminals 26 with the terminals 18 when the connectors 12 and 14 are mated as shown in FIGS. 1 and 4.

Since the lock plate 22 is assembled to the mating end of the connector body 18, there is good visibility for assembly and it is easy to inspect the assembled plug connector 12 for the proper number of correctly positioned terminals since each properly positioned terminal has its hook in plain sight at the mating end of the assembled plug connector 12. See FIG. 2 for instance.

As mentioned previously, a four-way arrangement in the connector plug 12 was illustrated for the sake of simplicity. However it is obvious that a nine-way arrangement having three rows of three side-by-side terminals is possible. It is then obvious that an arrangement having any number of rows or any number of terminals in a row is possible.

Another point is that the terminals 18 need not all be the same size as illustrated in the drawing. If, for instance, three high and one low current connections are to be made, one of the terminals 18 can be made smaller with a corresponding reduction in size of its terminal cavity 32 and cooperating hole 58 in the lock plate 22.

Consequently the lock plate arrangement provides great versatility in connector design with regard to the number, size and arrangement of terminals.

The mating socket connector 14 has a connector body 24 which is also a one-piece molding of dielectric material. It has a corresponding number, in this case four, terminal cavities 72 which open into a socket portion 74 at the mating end of the socket connector 14.

Each terminal cavity 72 has a stepped roof which provides a stop shoulder 76, a lock block 78 depending from the lower roof portion and a slot 80 through its floor at the front end adjacent the socket portion 74.

The terminals 26 are of one-piece sheet metal construction. Each terminal 26 comprises a channel-shaped median portion 82 comprising a floor 84 and two irregularly shaped side walls 86 each of which have a coplanar stop tab 88 and latch tang 90 which projects inwardly and rearwardly. The floor 84 has a square hole 92 which aligns with the slot 80 when terminal 26 is properly positioned in the terminal cavity 72.

The contact portion 94 at the forward end of the terminal 26 is a tongue-like extension of the floor 84 which is bent back over the floor 84 and supported on a floor tab 96 at its free end.

In view of the above configuration, the portions of the terminals 26 which project into the socket 74 are very strong yet the contact portion 94 has some flexibility for accommodating manufacturing variation in the box-like contacts of the mating terminals 18.

The terminals 26 have conventional crimpable attachment portions 98 at their rear ends.

The terminals 26 are inserted into the cavities 72 through their rear openings and individually retained in the cavities by the latch tangs 90 engaging the lock blocks 78. Over-insertion is prevented by the stop tabs 88 engaging the stop shoulders 76. After the terminals 26 are assembled in the connector body 24, the terminals 26 are positively locked as a group by inserting prongs 100 of the comb 30 through the connector body floor slots 80 and terminal floor holes 92. Each prong locks a tier of terminals 26 in the connector body 24 in both directions. The prongs 100 have lower bifurcated portions 102 as shown in FIG. 4. These bifurcated portions 102 are spring-like and spread apart after passing through the floor holes 92 in the lower-most terminal in each tier and retain the comb 30 assembled to the connector body 24.

The plug connector 12 and socket connector 14 are mated by inserting the mating end of the connector body 16 and attached lock plate 22 into the socket 74. The socket 74 includes channels 104 which cooperate with depending ribs 106 of the connector body 16 to insure proper indexing. During mating the lock plate 22 serves to guide the terminals 26 into proper mating engagement with the terminals 16. The plug connector 12 and socket connector 14 are locked together by conventional lock projections 108 and lock arms 110 on the respective connector bodies 16 and 24. When the connectors are mated, the lock plate 22 is trapped by the mating end face of the connector body 16 and surrounding portions of the socket 74.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector having a group terminal lock comprising:

a connector body having a mating end and a plurality of terminal cavities extending therethrough which define a pattern of openings at the mating end of the connector body, a plurality of terminals disposed in the terminal cavities, said terminals having contact portions and projecting hooks at one end which hooks extend through the openings at the mating end, and a lock plate attached to the connector body at the mating end, said lock plate having a plurality of holes which have a pattern corresponding to that of the openings at the mating end of the connector body and which are aligned with respective contact portions of the terminals for guiding mating terminals into engagement therewith, and said lock plate having portions adjacent the holes which partially block the openings and which are disposed behind the hooks to lock the plurality of terminals in the connector body as a group.

2. An electrical connector having a group terminal lock comprising:

a connector body having a mating end and a plurality of terminal cavities extending therethrough which define a pattern of openings at the mating end of the connector body, a plurality of terminals disposed in the terminal cavities, said terminals having box-like contact portions and projecting hooks at one end which extend forwardly and outwardly of the contact portions and through the openings at the mating end of the connector body, a lock plate attached to the connector body at the mating end, said lock plate having a plurality of holes which have a pattern corresponding to that of the openings at the mating end of the connector body and which are aligned with respective contact portions of the terminals, each said hole having a size and shape corresponding to that of its associated contact portion for guiding a mating terminal into engagement therewith, and said lock plate having portions adjacent the holes which partially block the openings at the mating end of the connector body and which are disposed behind the hooks to lock the plurality of terminals in the connector body as a group.

3. An electrical connector having a group terminal lock comprising:

a connector body having a mating end and a plurality of terminal cavities extending therethrough which define a pattern of openings at the mating end and opposite end of the connector body, a plurality of terminals disposed in the terminal cavities, said terminals having box-like contact portions and projecting hooks at one end which are insertable into the terminal cavities through the opening at the opposite end of the connector body, said hooks projecting forwardly and outwardly of the contact portions and extending through the openings at the mating end of the connector body, and a lock plate at the mating end of the connector body which is movable between an assembly position and a lock position, said lock plate having a plurality of holes which have a pattern corresponding to that of the openings at the mating end of the connector body and which are aligned with respective contact portions of the terminals when the lock plate is in the lock position, each said hole having a size and shape which corresponds to that of an associated contact portion for guiding a mating terminal into engagement therewith when the lock plate is in the lock position and which is of sufficient size and shape to permit an associated hook to pass through when the lock plate is in the assembly position and said lock plate having portions adjacent the holes which partially block the openings at the mating end of the connector body and which are disposed behind the hooks to lock the plurality of terminals in the connector body as a group when the lock plate is in the lock position.

4. An electrical plug connector having a group terminal lock for use with an electrical socket connector having a connector body with a socket at a mating end, comprising:

a connector body having a mating end adapted for insertion into the socket of the electrical socket connector and a plurality of terminal cavities extending therethrough which define a pattern of openings at the mating end of the connector body, a plurality of terminals disposed in the terminal cavities, said terminals having box-like contact portions and projecting hooks at one end which extend forwardly and outwardly of the contact portions and through the openings at the mating end of the connector body, a lock plate attached to the connector body at the mating end, said lock plate having a plurality of holes which have a pattern corresponding to that of the openings at the mating end of the connector body and which are aligned with respective contact portions of the terminals, each said hole having a size and shape corresponding to that of its associated contact portion for guiding a mating terminal of the electrical socket connector into engagement therewith, said lock plate having recessed portions adjacent the holes which partially block the openings at the mating end of the connector body and which are disposed behind the hooks to lock the plurality of terminals in the connector body as a group, and said lock plate being trapped by the mating end of the connector body and adjacent portions of the socket when the plug and socket connectors are mated.

* * * * *